US006931989B2

(12) United States Patent
Kashiwaba et al.

(10) Patent No.: US 6,931,989 B2
(45) Date of Patent: Aug. 23, 2005

(54) PRINT CHARACTERS SELECTOR OF PRINTING ENDLESS BAND IN PRINTER AND PRINTER OF PRINTING ENDLESS BANDS

(75) Inventors: Tadao Kashiwaba, Tokyo (JP); Tadashi Sasaki, Tokyo (JP)

(73) Assignee: Kabushiki Kaisha Sato (JP)

( * ) Notice: Subject to any disclaimer, the term of this patent is extended or adjusted under 35 U.S.C. 154(b) by 0 days.

(21) Appl. No.: 10/168,229

(22) PCT Filed: Oct. 15, 2001

(86) PCT No.: PCT/JP01/09025

§ 371 (c)(1),
(2), (4) Date: Sep. 3, 2002

(87) PCT Pub. No.: WO02/32685

PCT Pub. Date: Apr. 25, 2002

(65) Prior Publication Data

US 2003/0047091 A1 Mar. 13, 2003

(30) Foreign Application Priority Data

Oct. 18, 2000 (JP) ..... 2000-317348
Oct. 18, 2000 (JP) ..... 2000-317350
Oct. 18, 2000 (JP) ..... 2000-317352
Oct. 18, 2000 (JP) ..... 2000-317355

(51) Int. Cl.[7] ..... B41J 1/60; B41J 1/20; B41K 1/10

(52) U.S. Cl. ..... 101/111; 101/105

(58) Field of Search ..... 101/103, 105, 101/109, 111

(56) References Cited

U.S. PATENT DOCUMENTS 3,796,152 A * 3/1974 Finke et al. ..... 101/111
4,170,938 A * 10/1979 Sato ..... 101/111
4,176,600 A * 12/1979 Sato ..... 101/111
4,271,759 A * 6/1981 Volk ..... 101/110
4,284,004 A * 8/1981 Sato ..... 101/111
4,662,276 A 5/1987 Schrotz
5,619,916 A * 4/1997 Sekine ..... 101/111
6,009,805 A * 1/2000 Miketa et al. ..... 101/111

FOREIGN PATENT DOCUMENTS

EP 0867303 9/1998
EP 0 992 357 A 4/2000

(Continued)

OTHER PUBLICATIONS

Japanese Utility Model Application No. 149434/1981 (Laid – open No. 53660/1983), (Kabushiki Kaisha Sato), Apr. 12, 1983, Full text; Figs. 1 to 3.

(Continued)

*Primary Examiner*—Andrew H. Hirshfeld
*Assistant Examiner*—Leo T. Hinze
(74) *Attorney, Agent, or Firm*—Ostrolenk, Faber, Gerb & Soffen, LLP

(57) ABSTRACT

A device for selecting print characters of endless printing bands in a printer that, when restricting the rotation of endless printing bands for preventing fouling of display characters, can avoid excessive rotational force from acting on the endless printing bands and enable selection of desired print characters in cases where, for example, the endless printing band is for full-periphery printing or half-periphery printing. Both half-periphery printing capability and full-periphery printing capability can be implemented by providing regulating blocks capable of rotation as print pressure bearing members, the device is characterized in that selection of print characters is restricted by engagement of drive projections of an endless printing band and an elastic section of a movable stopper member and that, in the case where no drive projection engages with the elastic section, selection of print character is made possible and a regulating block receives the print pressure on the print character.

15 Claims, 10 Drawing Sheets

FOREIGN PATENT DOCUMENTS

| | | |
|---|---|---|
| JP | 6-286283 | 10/1994 |
| JP | 10-16368 | 1/1998 |
| JP | 10-44573 | 2/1998 |
| JP | 10-81049 | 3/1998 |
| JP | 10-337940 | 12/1998 |

OTHER PUBLICATIONS

Japanese utility Model Application No. 143339/1978 (Laid–open No. 30353/1980), Kabushiki Kaisha Sato Kenkyusho), Apr. 24, 1980, Full text; Figs. 1 to 3.

* cited by examiner

Fig, 1
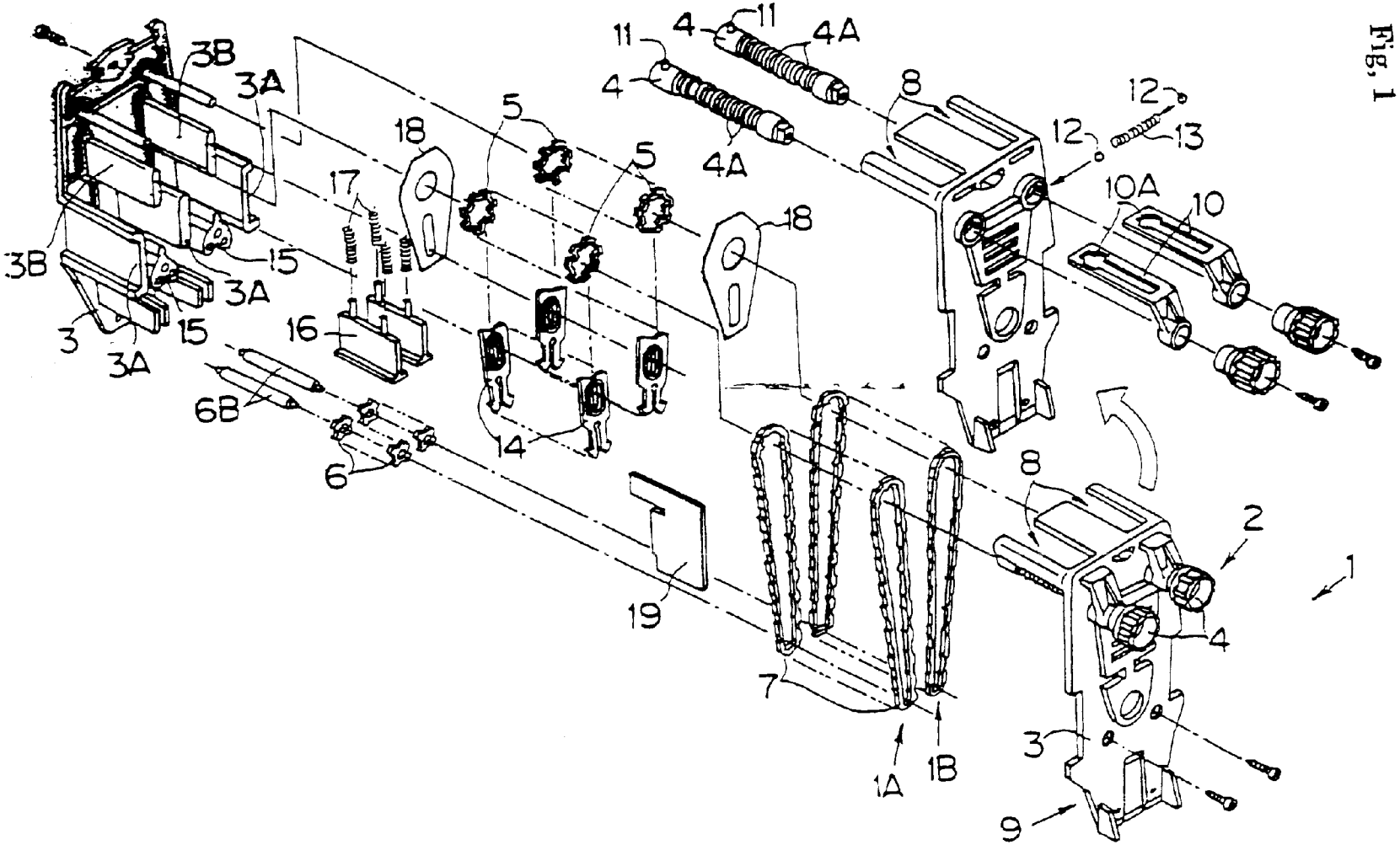

Fig, 2
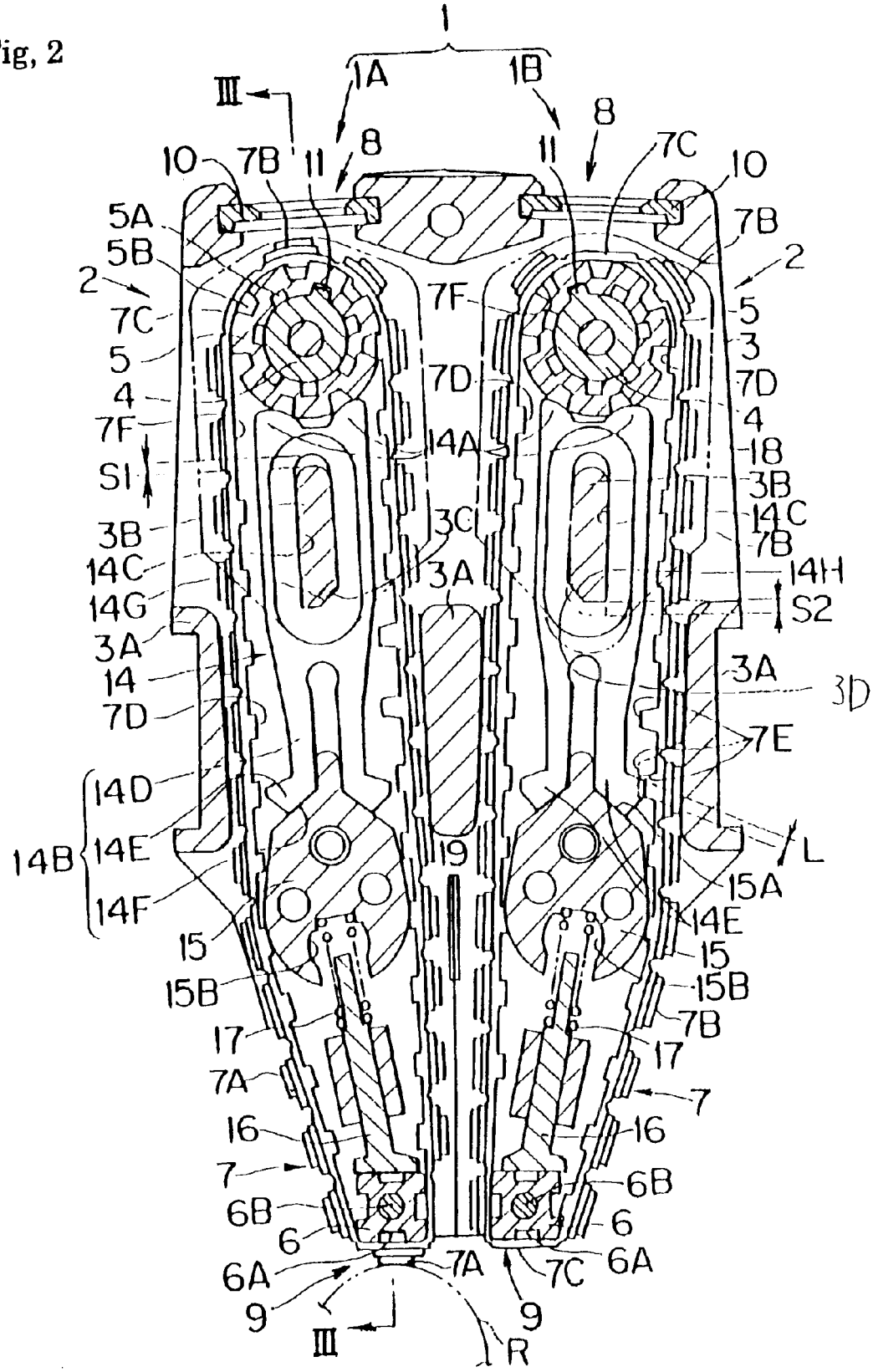

Fig, 3
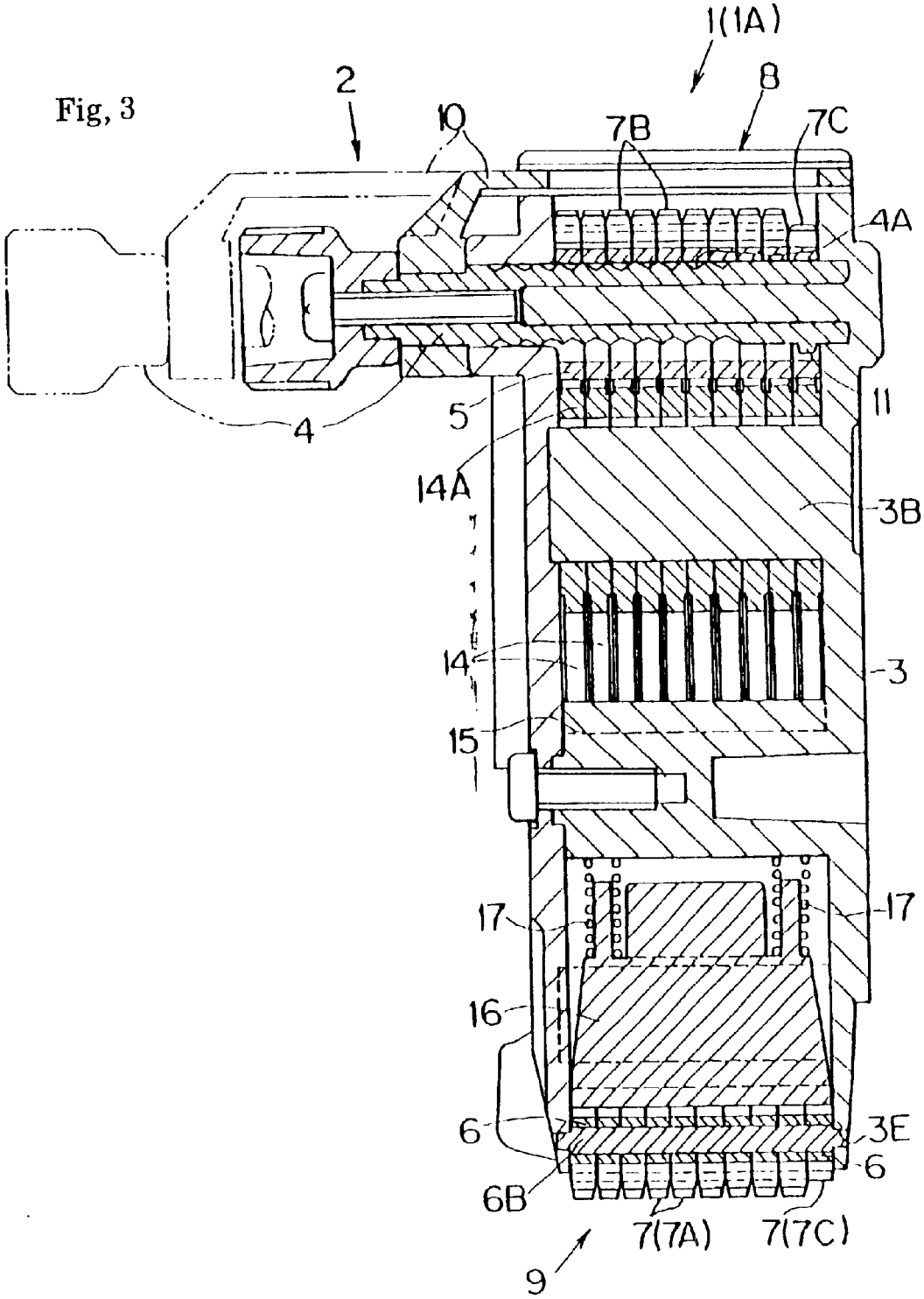

Fig, 4
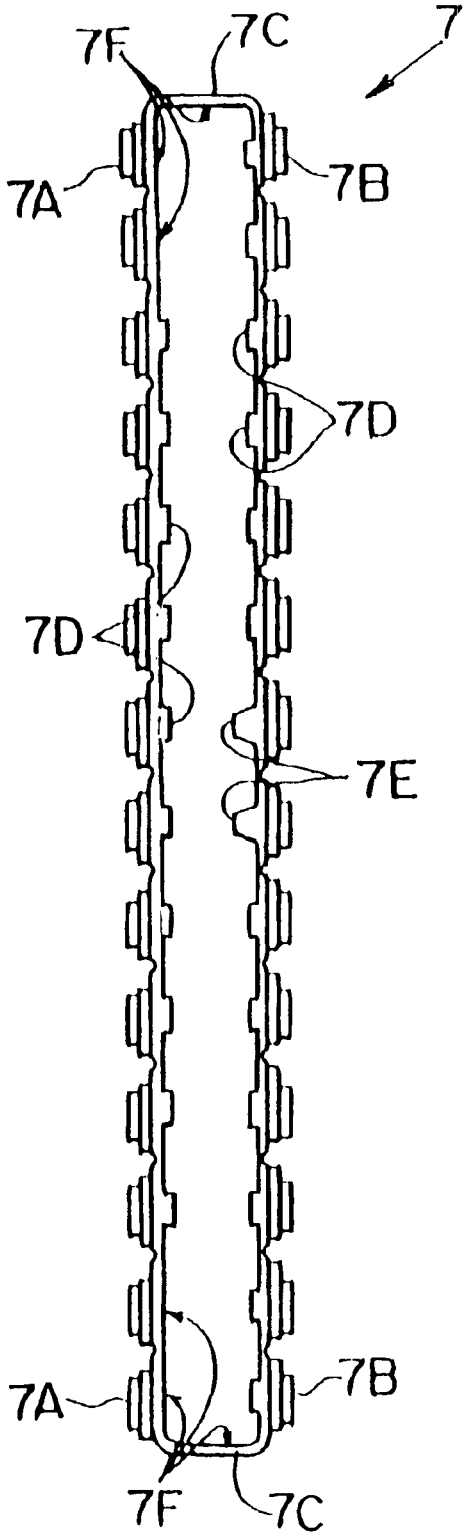

Fig, 5
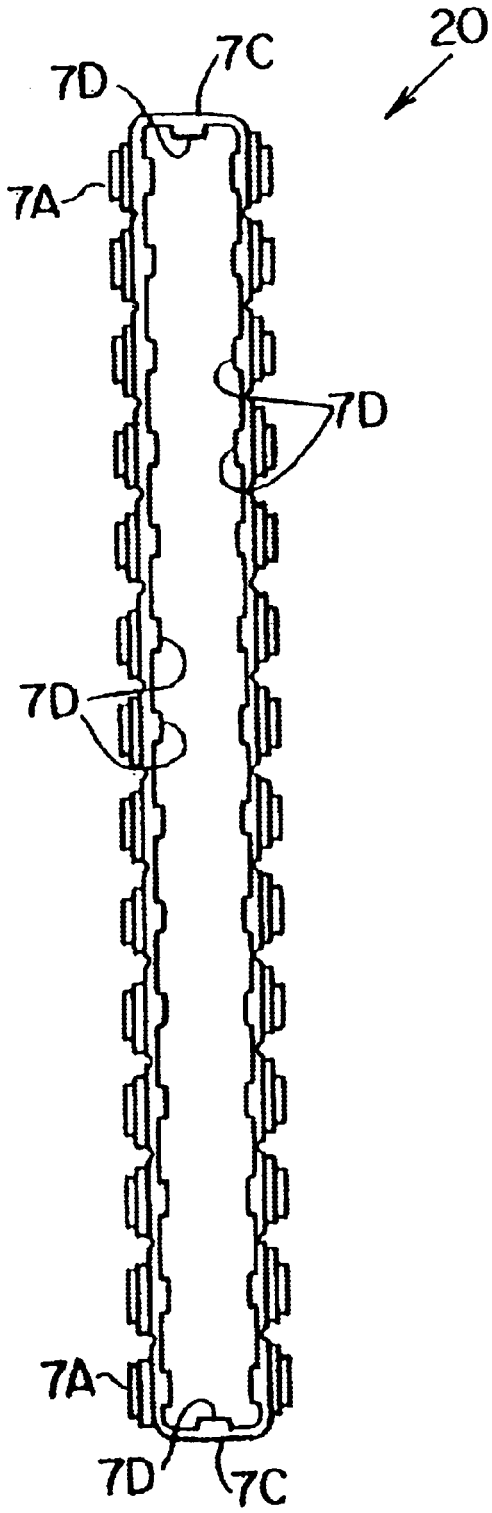

Fig, 6
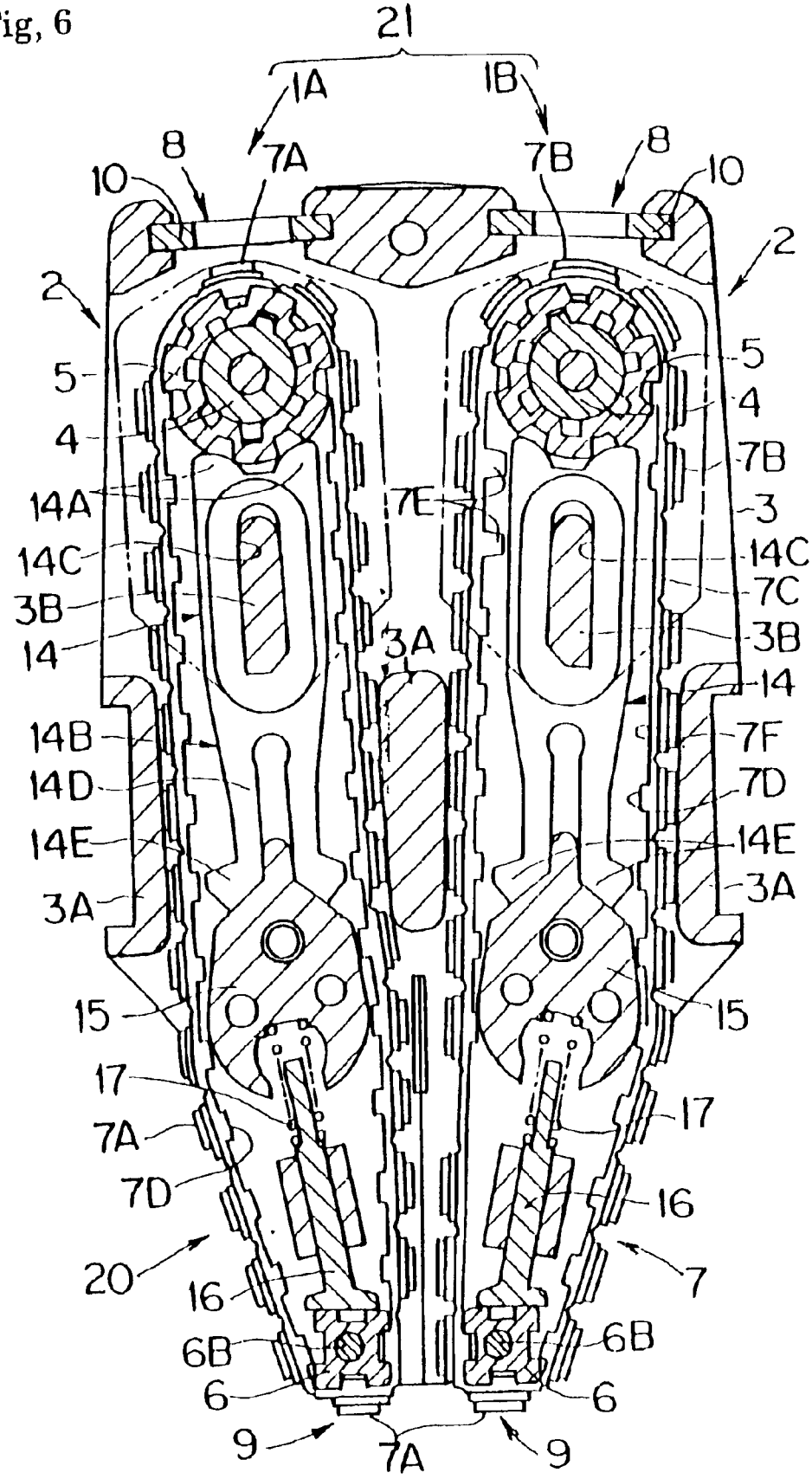

Fig, 7
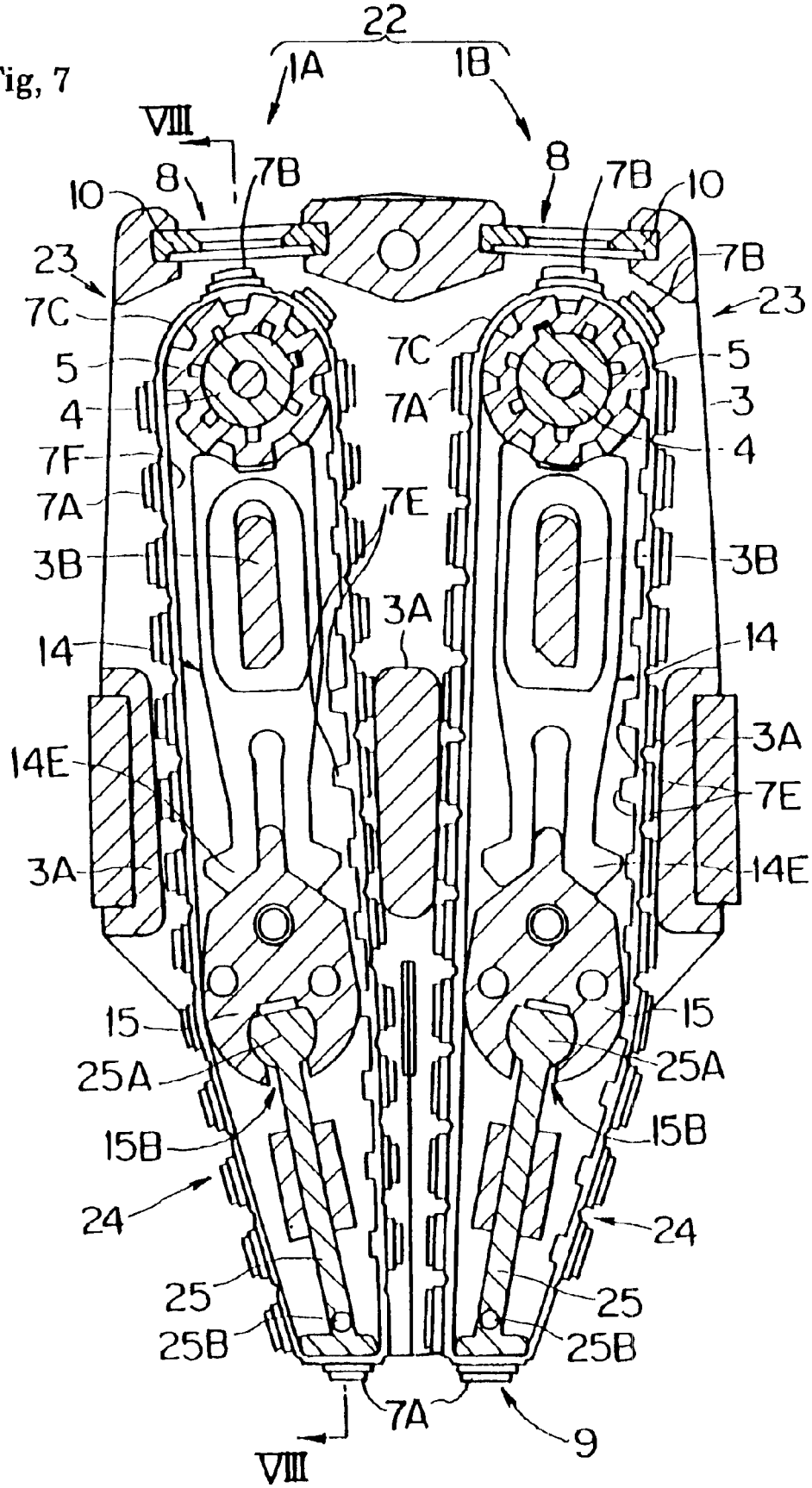

Fig, 8
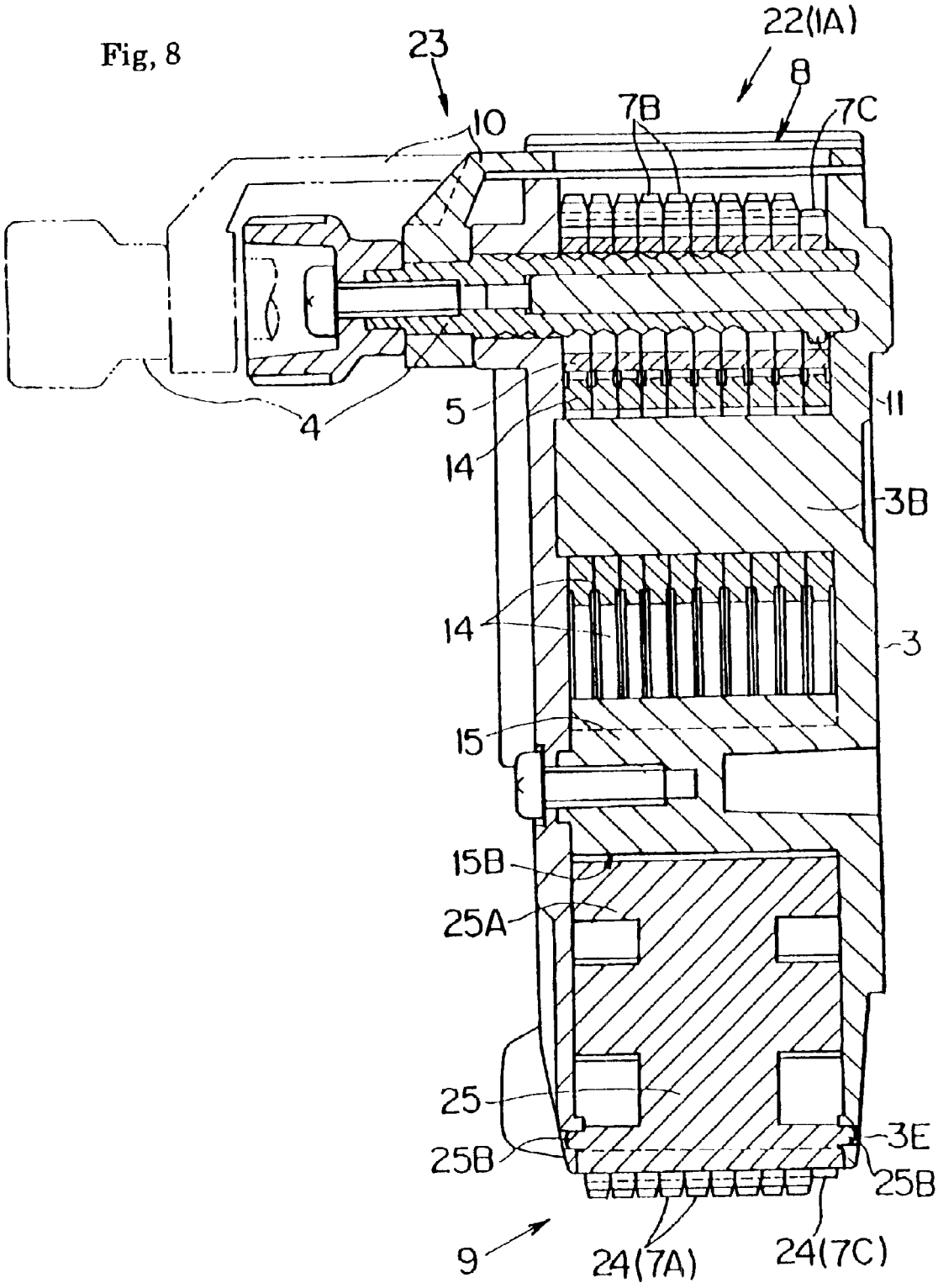

Fig, 9
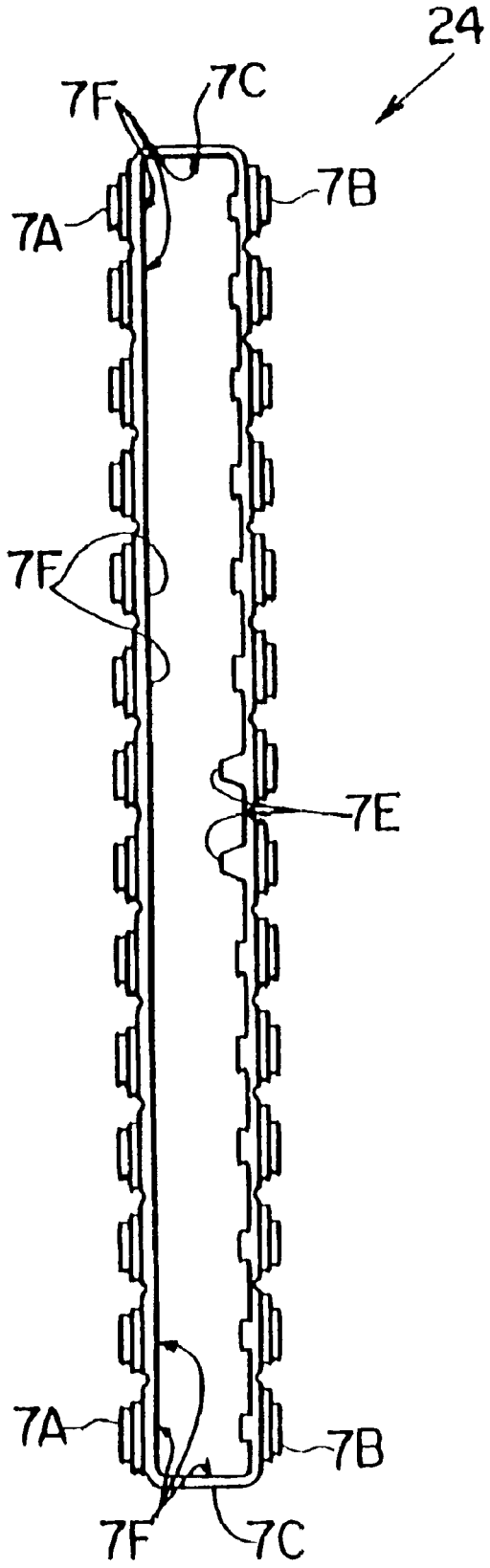

Fig, 10
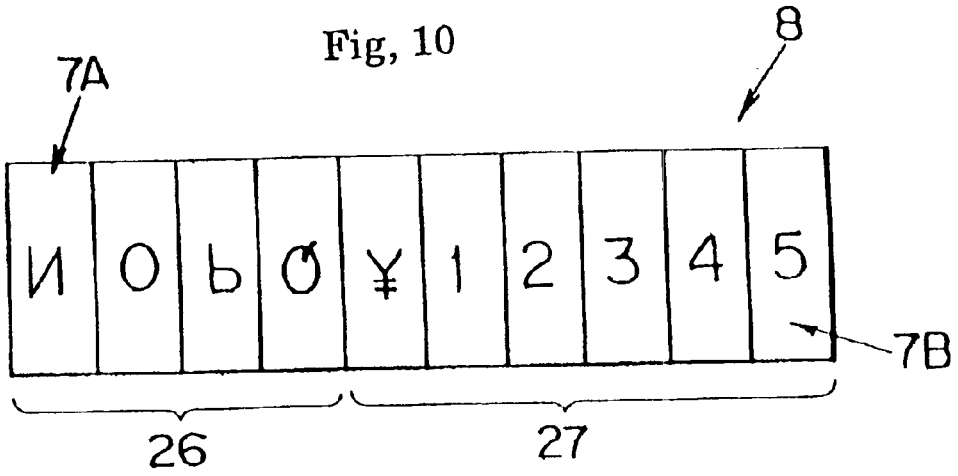
Fig, 11
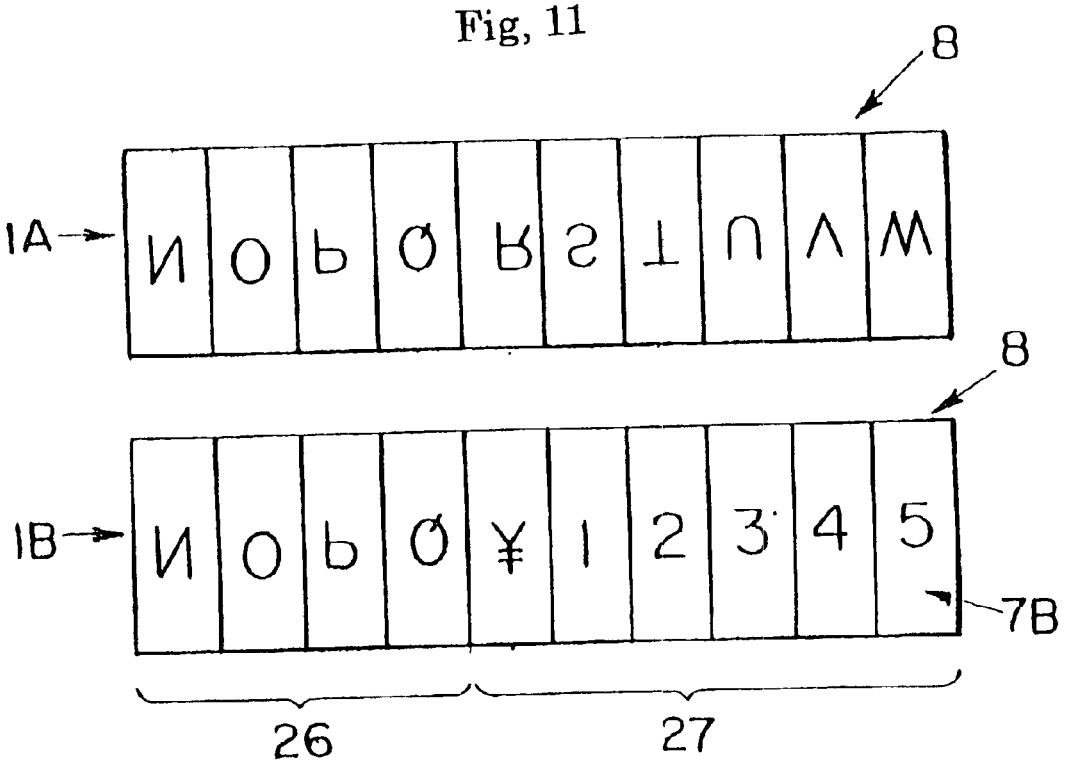

PRINT CHARACTERS SELECTOR OF PRINTING ENDLESS BAND IN PRINTER AND PRINTER OF PRINTING ENDLESS BANDS

BACKGROUND OF THE INVENTION (1) Field of the Invention

The present invention relates to a device for selecting print characters of endless printing bands in a printer, particularly a device for selecting print character of endless printing bands in a printer mounted in a portable printing and labeling device (hand labler).

(2) Background Art

In a conventional hand labeler or the like, print characters and display characters are formed on endless printing bands, these are rotated to put desired print characters in a printable state, ink is applied to the print characters by an ink roller or the like, and a label or the like is stamped.

However, when an endless printing band is made rotatable within an arbitrary rotation range, the display characters come opposite the ink roller and are fouled by application of ink.

For overcoming this problem, there is, as set out for example in Japanese Patent Application Laid-open No. Hei 10(1998)-44575, a device for preventing fouling of display characters in a printer wherein slack is produced in endless printing bands provided between selector wheels and a print character bearing base section (print pressure bearing section or print pressure bearing member) to enable idle rotation of the selector wheel. Although this device for preventing fouling of display characters in a printer prevents fouling of the display characters while enabling maintenance of endless printing band durability, it has a problem in that it is sometimes difficult to realize alignment in the print character selection operation at the print character bearing base section (proper setting state of individual print characters with respect to the print character bearing base section or distinction between set states).

Moreover, since the print character bearing base section is fixed, it receives the print pressure through the endless printing band and damage of the print character bearing base section by the impact force is therefore a problem.

Despite the fact that it may be desirable to increase the number of kinds of print characters in order to print more kinds of information, print characters can be formed on substantially only half the endless printing band peripheries when a structure is provided for preventing fouling of display characters. In the case where a conventional device for preventing fouling of display characters is provided, therefore, endless printing bands having print characters on most of their peripheries cannot be installed. This gives rise to the problem of not being able to support full-periphery printing.

In other words, no device for selecting print characters of endless printing bands has enabled selective adoption or combination of full-periphery printing capability permitting printing of many kinds of information owing to the formation of print characters over the entire periphery of endless printing bands and half-periphery printing capability permitting prevention of display character fouling but allowing printing over only half the peripheries so as to enable printing of desired amounts of information with a desired number of print characters and also, when necessary, enable prevention of display character fouling.

BRIEF SUMMARY OF THE INVENTION

The present invention was accomplished in light of the foregoing problems and has as an object to provide a device for selecting print characters of endless printing bands in a printer capable of preventing fouling of display characters on endless printing bands by not positioning them at a print pressure bearing section, i.e., by not bringing them opposite an ink roller.

Another object of the present invention is to provide a device for selecting print characters of endless printing bands in a printer that, when restricting the rotation of endless printing bands for preventing display character fouling, can avoid wear, cracking and other damage of the endless printing bands by preventing excessive rotational force from acting thereon.

Another object of the present invention is to provide a device for selecting print characters of endless printing bands in a printer that, when excessive force is used in an attempt to rotate an endless printing band whose rotation has been restricted, allows a selector wheel to rotate idly and does not apply appreciable load on the endless printing band.

Another object of the present invention is to provide a device for selecting print characters of endless printing bands in a printer that can prevent misassembly of movable stopper members.

Another object of the present invention is to provide a device for selecting print characters of endless printing bands in a printer capable of improving assembly workability and reducing cost by enabling prevention of movable stopper member misassembly particularly in a two-stage printer.

Another object of the present invention is to provide a device for selecting print characters of endless printing bands in a printer that enables interchange of regulating blocks in accordance with type of endless printing band.

Another object of the present invention is to provide a device for selecting print characters of endless printing bands in a printer equipped with print character bearing bases capable of optimizing reduction of damage by print pressure impact via the endless printing band and abrasion between the endless printing bands and print character bearing bases.

Another object of the present invention is to provide a device for selecting print characters of endless printing bands in a printer that, when a given print pressure acts on the print characters of the endless printing bands, can absorb it with a prescribed degree of cushioning.

Another object of the present invention is to provide a device for selecting print characters of endless printing bands in a printer that enables selection of prescribed print characters in accordance with the type of endless printing band, i.e., both in the case where print characters are formed over the entire periphery of the endless printing band (fill-periphery printing) and in the case where print characters are formed over about half the periphery of the endless printing band and display characters formed on the remaining approximately one half of the periphery are prevented from being fouled (half-periphery printing).

Another object of the present invention is to provide a printer with various types of endless printing bands.

Another object of the present invention is to provide a printer with endless printing bands that enables the type and number of the print characters and display characters formed on the endless printing band to be designed in accordance with the type and number of types of information to be printed.

Another object of the present invention is to provide a printer with endless printing bands that enables selection of desired types of endless printing bands, i.e., between endless printing bands formed with print characters over the entire periphery of the endless printing band (full-periphery printing) and endless printing bands formed with print characters over about half the periphery and with display characters that are prevented from being fouled over the remaining approximately one half of the periphery (half-periphery printing).

Specifically, the present invention focuses on the fact that both half-periphery printing capability and full-periphery printing capability can be imparted by providing regulating blocks capable of rotation as print pressure bearing members at the print pressure bearing section and that, if required, a configuration permitting idle rotation of the selector wheels can be implemented. In a first aspect, the present invention is a device for selecting print characters of endless printing bands in a printer that has at least one endless printing band formed with multiple print characters spaced at regular intervals and provided between a selector wheel and a print pressure bearing member attached to a printer frame and that enables selection of desired ones of the print characters of the endless printing band, the device for selecting print characters of endless printing bands in a printer being characterized in comprising: a movable stopper member that has regulating boss portions for engaging the selector wheel and an elastic section on the side of the print pressure bearing member and is located between the selector wheel and the print pressure bearing member; a stopper bearing member that abuts on the elastic section of the movable stopper member to regulate movement of the movable stopper member, drive projections formed on an inner peripheral surface of the endless printing band to be engageable with the selector wheel; and a regulating block that engages with the drive projections of the endless printing band and is capable of rotating forward and backward with movement of the endless printing band to position the print characters at print positions where they properly receive print pressure; when a drive projection can engage the elastic section of the movable stopper member, engagement between the drive projection and the elastic section with movement of the endless printing band restricting selection of print characters of the endless printing band while enabling slight movement of the movable stopper member, and when no drive projection of the endless printing band engages the elastic section of the movable stopper member, selection of print characters with movement of the endless printing band being enabled and the regulating block being made capable of receiving the print pressure on the print character.

In a second aspect, the present invention is a device for selecting print characters of endless printing bands in a printer which has at least one endless printing band that is formed with multiple print characters spaced at regular intervals and is provided between a selector wheel and a print pressure bearing member attached to a printer frame and which enables selection of desired ones of the print characters of the endless printing band, the device for selecting print characters of endless printing bands in a printer being characterized in comprising: a movable stopper member that has regulating boss portions for engaging the selector wheel and an elastic section on the side of the print pressure bearing member and is located between the selector wheel and the print pressure bearing member, a stopper bearing member that abuts on the elastic section of the movable stopper member to regulate movement of the movable stopper member; drive projections formed on an inner peripheral surface of the endless printing band to be engageable with the selector wheel; and a regulating block that engages with the drive projections of the endless printing band and is capable of rotating forward and backward with movement of the endless printing band to position the print characters at print positions where they properly receive print pressure; engagement between a drive projection and the elastic section with movement of the endless printing band producing slack in the endless printing band to enable idle rotation of the selector wheel.

An elongate guide window for sliding engagement with a stopper guide formed on the printer frame can be formed in the movable stopper member to make the movable stopper member mountable on the stopper guide and a printer frame side misassembly preventing slanted surface and a stopper member side misassembly preventing slanted surface can be formed on the stopper guide and the elongate guide window to be engageable with each other.

The printer can have a first-stage printer section and a second-stage printer section;

in the first-stage printer section a first frame side misassembly preventing slanted surface can be formed on the printer frame and a first stopper member side misassembly preventing slanted surface capable of engaging with the first frame side misassembly preventing slanted surface can be formed on the movable stopper member thereof; and in the second-stage printer section a second frame side misassembly preventing slanted surface can be formed on the printer frame and a second stopper member side misassembly preventing slanted surface capable of engaging with the second frame side misassembly preventing slanted surface can be provided on the movable stopper member thereof;

the first-stage printer section and second-stage printer section each having:

the endless printing band formed with the drive projections;

the movable stopper member mounted on the printer frame; and the stopper bearing member.

The regulating block can be interchangeable with a print character bearing base fixedly mountable on the printer frame.

The print character bearing base can be constituted of a harder material than the printer frame.

The endless printing band can have outer peripheral flat portions not formed with print characters and inner peripheral side flat portions that are located opposite the print characters and engage with the print character bearing base side.

The endless printing band can be interchangeable with another endless printing band whose drive projections are differently configured.

The endless printing band can have high drive projections for engaging with the movable stopper member and low drive projections that do not engage with the movable stopper member.

The endless printing band can have only low drive projections that do not engage with the movable stopper member.

The endless printing band can have outer peripheral side flat portions not formed with print characters and inner peripheral side flat portions that face the regulating block side and are located opposite the outer peripheral side flat portions thereat.

In the device for selecting print characters of endless printing bands in a printer according to the present invention, since half-periphery printing capability or full-periphery printing capability can be imparted by providing regulating blocks to be capable of rotation at the print pressure bearing section and a configuration permitting idle rotation of the selector wheels during half-periphery printing is made feasible to enable display character fouling prevention, it is therefore possible to implement full-periphery printing and half-periphery printing capability (with display characters fouling prevention capability) as desired by free selection of endless printing bands.

In other words, the regulating blocks can engage with the drive projections on the inner peripheral surface side of the endless printing band and support either full-periphery printing or half-periphery printing configuration, and further, particularly in the case of half-periphery printing, engagement between the drive projections of the endless printing bands and the movable stopper member produces slack in the endless printing band to permit idle rotation of the selector wheel so as to avoid contact of the display characters with the ink roller and thereby prevent fouling.

A third aspect of the invention, which focuses on utilizing half-periphery printing capability or full-periphery printing capability at desired rows and on making display character fouling prevention feasible if required, is a printer with endless printing bands having an array of multiple rows of endless printing bands formed with multiple print characters and enabling selection of a print character of a desired row of the endless printing bands, which printer with endless printing bands is characterized in that the endless printing bands of some rows of the multiple rows are formed over almost their entire peripheries with the print characters; and the endless printing bands of some rows of the multiple rows are formed over about half their peripheries with the print characters.

A fourth aspect of the invention is a printer with endless printing bands having an array of multiple rows of endless printing bands formed with multiple print characters and enabling selection of a print character of a desired row of the endless printing bands, which printer with endless printing bands is characterized in that the endless printing bands of a first printing region of the multiple rows are formed over almost their entire peripheries with the print characters; and the endless printing bands of a second region of the multiple rows are formed over about half their peripheries with the print characters.

The endless printing bands formed over about half their peripheries with the print characters can have display characters corresponding to the print characters.

The display characters can be prevented from being fouled by an ink roller for applying ink to the print characters.

BRIEF DESCRIPTION OF THE DRAWINGS

FIG. 1 is an exploded perspective view of a printer 1 equipped with a print character selecting device 2 that is an embodiment of the present invention.

FIG. 2 is sectional view of the printer 1.

FIG. 3 is a sectional view taken along line III—III in FIG. 2.

FIG. 4 is a side view of an endless printing band 7 (for half-periphery printing).

FIG. 5 is a side view of another endless printing band 20 (for full-periphery printing).

FIG. 6 is a sectional view showing an example (printer 21) in which the endless printing band 20 is installed on one printer section (top printer section 1A) side.

FIG. 7 is a sectional view of the printer 22 and a device for selecting print characters of endless printing bands 23 thereof.

FIG. 8 is a sectional view taken along line VIII—VIII in FIG. 7.

FIG. 9 is a side view of an endless printing band 24 (for half-periphery printing).

FIG. 10 is a plan view of the display window 8 of a single-stage printer.

FIG. 11 is a plan view of the display windows 8 of a two-stage printer.

REFERENCE NUMERALS

1 Printer (FIG. 1, FIG. 2)

1A Top printer section of printer 1 (first stage printer section)

1B Bottom printer section of printer 1 (second stage printer section)

2 Print character selecting device for endless printing band 7 in printer 1 (embodiment, FIG. 2)

3 Printer frame

3A Presser frame of printer frame 3

3B Stopper guide of printer frame 3

3C First frame side misassembly preventing slanted surface of stopper guide 3B

3D Second frame side misassembly preventing slanted surface of stopper guide 3B

3E Shaft supporting hole of printer frame 3 (FIG. 3, FIG. 8)

4 Operating shaft for print character selection

4A Locator groove of operating shaft 4 for print character selection

5 Selector wheels for multiple rows

5A Internal engagement recess of selector wheel 5

5B Peripheral engagement notch of selector wheel 5

6 Regulating blocks of multiple rows (print pressure bearing members)

6A Projection engaging groove of regulating block 6

6B Block shaft of regulating block 6

7 Endless printing bands of multiple rows (for half-periphery printing, for display character fouling prevention, FIG. 4)

7A Print character of endless printing band 7

7B Display character of endless printing band 7

7C Blank section of endless printing band 7 (outer peripheral flat portion)

7D Low drive projection of endless printing band 7

7E High drive projection of endless printing band 7

7F Outer peripheral flat portion of endless printing band 7

8 Display window

9 Ink roller access opening

10 Indicator

10A Pointer window portion of indicator 10

11 Rotary pin

12 Steel locator ball

13 Locator spring 14 Movable stopper members of multiple rows (band stoppers)

14A Pair of regulating boss portions of movable stopper member 14

14B Elastic section of movable stopper member 14

14C Elongate guide window of movable stopper member 14

14D Bifurcated engagement spring section of elastic section 14B

14E Projecting engagement piece of elastic section 14B

14F Slanted surface of elastic portion of elastic section 14B

14G First stopper member side misassembly preventing slanted surface of elongate guide window 14C

14H Second stopper member side misassembly preventing slanted surface of elongate guide window 14C

15 Stopper bearing member

15A Bearing member slanted surface of stopper bearing member 15

15B Engagement hole of stopper bearing member 15 (FIG. 7)

16 Regulating block bearing member

17 Block spring

18 Display spacer

19 Band shutter

20 Endless printing band (for full-periphery printing, FIG. 5)

21 Printer (FIG. 6)

22 Printer (FIG. 7, FIG. 8)

23 Device for selecting print characters of endless printing band 24 in printer 22

24 Endless printing band (for half-periphery printing, for display characters fouling prevention, FIG. 9)

25 Print character bearing base (print pressure bearing member)

25A Enlarged fastening portion of print character bearing base 25

25B Fixing shaft of print character bearing base 25

26 First print region (full-periphery printing) (FIG. 10, FIG. 11)

27 Second print region (half-periphery printing) (FIG. 10, FIG. 11)

L Slight interval over which high drive projection 7E and projecting engagement piece

14E move in engagement (lap length)

R Ink roller

S1 Upper-side gap between elongate guide window 14C and stopper guide 3B

S2 Lower-side gap between elongate guide window 14C and stopper guide 3B

DETAILED DESCRIPTION OF THE INVENTION

A printer 1 equipped with a device for selecting print characters of endless printing bands in a printer that is an embodiment of the invention will now be explained based on FIGS. 1 to 11.

FIG. 1 is an exploded perspective view of the printer 1, FIG. 2 is sectional view of the printer 1 and FIG. 3 is a sectional view taken along line III—III in FIG. 2. The printer 1 has a print character selecting device 2, a pair of left and right printer frames 3, operating shafts 4 for print character selection, multiple rows of selector wheels 5, multiple rows of regulating blocks 6 (print pressure bearing members) and multiple rows of endless printing bands 7.

Although, the printer 1 is of two-stage structure having a top printer section 1A (first-stage printer section) and a bottom printer section 1B (second-stage printer section), the print character selecting device 2 itself can as required be applied to a single-stage printer or other multi-stage printer.

The printer frame 3 is formed at the upper portion with a display window 8 and at the lower portion with an ink roller access opening 9.

The printer frame 3 is formed with a presser frame 3A.

A single (or in the case of a two-color system, for each color an independent) ink roller R can roll into contact with the endless printing bands 7 at the ink roller access opening 9.

Each operating shaft 4 is for selecting specific print characters 7A in an endless printing band 7 (FIG. 4) by moving it in the axial direction to select (locate) a desired row of the endless printing bands 7 and rotating the selector wheel 5 of the located row. It has an indicator 10 fitted thereon and is formed with a projecting rotary pin 11 (see FIG. 3).

As shown particularly in FIGS. 1 and 3, each operating shaft 4 is formed on its outer peripheral surface with multiple rows of locator grooves 4A spaced regularly in the axial direction and the operating shaft 4 and the indicator 10 can be set (located) at a prescribed row by a steel locator ball 12 and a locator spring 13 that urges the steel locator ball 12 toward the locator grooves 4A.

The indicator 10 moves integrally with the operating shaft 4 in the axial direction of the operating shaft 4, is free in the rotational direction, and is formed in the display window 8 with a pointer window portion 10A. The pointer window portion 10A points to the desired row.

The rotary pin 11 moves and rotates integrally with the operating shaft 4. It projects onto the inner peripheral surfaces of the selector wheels 5 and can be engaged with the internal engagement recess 5A (FIG. 2) of the selector wheel 5 of a desired row.

As shown particularly in FIGS. 1 and 2, the endless printing bands 7 are extended between the selector wheels 5 and the regulating blocks 6 under prescribed tension.

The regulating blocks 6 are square in cross-section. Each is formed on every side with a projection engaging groove 6A and is rotatable around a block shaft 6B in the forward and backward directions as desired.

FIG. 4 is a side view of an endless printing band 7. The endless printing band 7 is formed at separate regions on its outer peripheral surface with prescribed numbers (e.g., 14 each) of print characters 7A and display characters 7B that are regularly spaced and all rise to the same height from the band reference plane.

However, a blank section 7C with no print characters (outer peripheral flat portion) is formed at each boundary region and, as explained later, the blank sections 7C face the display window 8 and the ink roller access opening 9 when the rotation of the selector wheel 5 is stopped. (allowed to rotate idly) to prevent movement of the endless printing band 7.

The portions of the inner peripheral surface of the endless printing band 7 opposite the print characters 7A and the display characters 7B are formed with low drive projections 7D and high drive projections 7E each engageable with peripheral engagement notches 5B of the selector wheel 5.

The low drive projections 7D can engage with the projection engaging grooves 6A of the regulating block 6.

The high drive projections 7E are located on the inner peripheral side of the display characters 7B and a pair thereof are formed adjacently at a center position.

So long as laterally symmetrical on the inner peripheral surface of the endless printing band 7, the number of high drive projections 7E can be freely set in light of the numbers of the print characters 7A and the display characters 7B and the like to extend over a prescribed region on the inner peripheral surface of the endless printing band 7.

In addition, the inner peripheral surface at the print characters 7A adjacent to the blank section 7C on the downstream side thereof in the direction of drive rotation (upstream side in the direction of idle rotation) of the endless printing band 7 is not formed with low drive projections 7D but is formed as flat portions 7F.

Regarding the number of flat portions 7F, although the illustrated example shows sets of three on the inner peripheral surface of the endless printing band 7, including those on the inner peripheral portion opposite the blank sections 7C, the flat portions 7F can be of any number insofar as the endless printing band 7 can be rotationally driven by the selector wheel 5 and rotate idly as explained later.

When the selector wheel 5 is rotated, the low drive projections 7D and the high drive projections 7E engage with the peripheral engagement notches 5B of the selector wheel 5 to enable a desired print character 7A to contact the ink roller R at the ink roller access opening 9.

However, the display characters 7B do not contact the ink roller R.

Specifically, as shown particularly in FIGS. 1 and 2, multiple rows of movable stopper members 14 (band stoppers) and stopper bearing members 15 integral with the printer frame 3 are provided on the printer frame 3.

The movable stopper members 14 are located between the selector wheels 5 and the regulating blocks 6 and each has a pair of regulating boss portions 14A for engaging a selector wheel 5 and, on the side of the regulating block 6, an elastic section 14B.

Further, the movable stopper members 14 can engage/disengage the regulating boss portions 14A with/from the peripheral engagement notches 5B of the selector wheels 5.

However, as shown in FIG. 2, elongate guide windows 14C are formed at the center portions of the movable stopper members 14, and stopper guides 3B provided to project from the printer frame 3 fit into these elongate guide windows 14C.

In the normal selectable state, upper-side gaps S1 are formed between the elongate guide windows 14C and the stopper guides 3B, and the movable stopper members 14 can move downward in the drawing and also return.

Each elastic section 14B has a bifurcated engagement spring section 14D, projecting engagement pieces 14E that engage the high drive projections 7E, and elastic section slanted surfaces 14F.

The stopper bearing members 15 are located between the movable stopper members 14 and the regulating blocks 6 and have bearing member slanted surfaces 15A which abut on the elastic sections 14B (the elastic section slanted surfaces 14F).

The stopper bearing members 15 abut on the elastic sections 14B of the movable stopper members 14 to restrict the movement of the movable stopper members 14.

The elongate guide windows 14C of the movable stopper members 14 are made asymmetrical. Specifically, the elongate guide windows 14C on the top printer section 1A (first-stage printer section) side and that on the bottom printer section 1B (second-stage printer section) side are respectively provided either at the upper or lower end thereof (e.g., at the lower end as in the drawing) with a first stopper member side misassembly preventing slanted surface 14G and a second stopper member side misassembly preventing slanted surface 14H. The stopper guides 3B are provided with a first frame side misassembly preventing slanted surface 3C associated with the first stopper member side misassembly preventing slanted surface 14G and a second frame side misassembly preventing slanted surface 3D associated with the second stopper member side misassembly preventing slanted surface 14H. By this, the elongate guide windows 14C of the top printer section 1A and the bottom printer section 1B can be prevented from misassembly with respect to the movable stopper members 14.

The reason for this will be explained. Since the lateral separation as viewed in FIG. 2 of the printer section 1A and bottom printer section 1B gradually decreases from the display windows 8 to the Ink roller access opening 9, the center positions of the display characters 7B in the display windows 8 are slightly tilted in opposite directions with respect to the central axis between the top printer section 1A and bottom printer section 1B (stopper guides 3B). The regulating boss portions 14A of the movable stopper members 14 are therefore not at laterally symmetrical positions with respect to the center line between the movable stopper members 14 and have to be properly assembled with respect to the selector wheel 5.

Here, when the movable stopper members 14 of the top printer section 1A and the bottom printer section 1B are assembled with the stopper guides 3B, since the first stopper member side misassembly preventing slanted surface 14G in the top printer section 1A and second stopper member side misassembly preventing slanted surface 14H in the bottom printer section 1B slant in opposite directions and the first stopper member side misassembly preventing slanted surface 14G and second stopper member side misassembly preventing slanted surface 14H are each assembled with the one of the first frame side misassembly preventing slanted surface 3C and second frame side misassembly preventing slanted surface 3D whose slant direction matches its own, each movable stopper member 14 can be properly assembled with respected to the associated selector wheel 5 and misassembly with respect to the selector wheel 5 can be prevented.

In the two-stage printer 1 having the top printer section 1A and the bottom printer section 1B, however, the index positions themselves of the print characters 7A and display characters 7B are at center positions of the display windows 8 and at mutually symmetrical positions. Common or shared use of components like the movable stopper members 14 and the selector wheels 5 is therefore possible by flipping them over before assembly to match with the first stopper member side misassembly preventing slanted surface 14G or the second stopper member side misassembly preventing slanted surface 14H.

As shown particularly in FIGS. 1 and 2, a regulating block bearing member 16 abuts on each regulating block 6 and a pair of block springs 17 spaced laterally as viewed in FIG. 3 are disposed between each regulating block bearing member 16 and the associated stopper bearing member 15 to enable setting of the regulating block 6 at a print position located at the center of the ink roller access opening 9 or at a prescribed print pressure bearing section so that the regulating block 6 can receive print pressure and, further, to enable regulated rotation of the regulating block 6 together with the rotary motion of the endless printing band 7 of the associated row by tilting of the regulating block bearing member 16 to a prescribed attitude or angle and restoration thereof to the illustrated position.

As shown particularly in FIG. 3, each block shaft 6B is engaged with shaft supporting holes 3E of the printer frames 3.

As shown particularly in FIGS. 1 and 2, display spacers 18 are provided between the rows composed of endless printing bands 7, movable stopper members 14 and selectors wheel 5 so that when the selector wheel 5 of one row is rotating the selector wheel of the adjacent row(s) is prevented from rotating together with it.

In addition, a band shutter 19 is provided between the top printer section 1A and the bottom printer section 1B to ensure smooth rotation of adjacent endless printing bands 7.

As shown in FIGS. 2 and 3, in the printer 1 and the endless printing band 7 print character selecting device 2 configured in this manner, when in the normal print character selection state a desired row is selected by moving one of the operating shafts 4 in the axial direction and, if rotation is effected in either the forward or backward direction at that row, the associated selector wheel 5 rotates the endless printing band 7, causing the associated regulating block 6 at the print pressure bearing section also to rotate synchronously under appropriate regulation, and is stopped at the position where the desired display character 7B of the endless printing band 7 can be seen through the display window 8.

In this selected state, the print character 7A corresponding to the selected display character 7B is set on the regulating block 6 and exposed at the ink roller access opening 9. Printing can be effected by turning the ink roller R to apply ink to this print character 7A and pressing the whole printer 1 onto a label by, for example, operating a hand lever (not shown) or the like.

The sectional view of FIG. 2 shows an endless printing band 7 of the bottom printer section 1B (on the right side of the drawing) when rotated clockwise in the drawing to the rotation-prevented state (idle rotation state). Even if it is attempted to first rotate the operating shaft 4 at a certain row to rotate the selector wheel 5 and rotate the endless printing band 7 clockwise, a high drive projection 7E of the endless printing band 7 engages with one projecting engagement piece 14E (right side of the drawing) of the elastic section 14B of the movable stopper member 14.

The engagement between the high drive projection 7E and the engagement piece 14E therefore restricts movement of the high drive projections 7E and the projecting engagement piece 14E to a small interval (lap length L) and prevents the selector wheel 5 from rotating even if an attempt is made to rotate the selector wheel 5 further, whereby blank sections 7C come to face the display window 8 and the ink roller access opening 9, the positioning of a display character 7B of the endless printing band 7 at the ink roller access opening 9 is avoided, and fouling of display characters 7B by the ink roller R is prevented.

More specifically, the endless printing bands 7 are imparted with a certain amount of slack by fabricating them to be slightly greater in total length than the basic total length between the selector wheels 5 and the regulating blocks 6. When a projecting engagement piece 14E of a movable stopper member 14 is in engagement with a high drive projection 7E of an endless printing band 7 and an attempt is made to rotate the associated selector wheel 5 further in the movable direction, stress is produced that tends to make slack concentrate at the low drive projections 7D in the direction of rotation between the high drive projection 7E and, particularly, the blank section 7C of the endless printing band 7. These low drive projections 7D rise off the selector wheel 5 to release the engagement with the peripheral engagement notches 5B so that the selector wheel 5 rotates idly.

The sectional view of FIG. 2 shows the idle rotation state of a selector wheel 5 of the bottom printer section 1B.

In the aforesaid rotation-prevented state, when excessive force is used in an attempt to rotate the endless printing band further, the movable stopper member 14 moves downward in the drawing by the lap length L guided by the stopper guide 3B, a lower-side gap S2 is produced between the elongate guide window 14C and the stopper guide 3B, the laterally bifurcated engagement spring section 14D of the elastic section 14B spreads outward as the slanted surfaces 14F move along the upper bearing member slanted surfaces 1SA, and the engagement between the projecting engagement piece 14E and the high drive projection 7E of the endless printing band 7 is further strengthened.

In this state, as explained above, the selector wheel 5 rotates idly because slack develops in the endless printing band 7 between the portion of the blank section 7C on the upper side in FIG. 2 and the portion of the engagement piece 14E so that the low drive projections 7D escape from the peripheral engagement notches 5B of the selector wheel 5.

Since the engagement portion between the engagement piece 14E and the high drive projection 7E is located downstream in the direction of rotation of the selector wheel 5 and the endless printing band 7 and, further, the presser frame 3A restrains the endless printing band 7 and keeps it from bulging outward, the amount of slack developed between the selector wheel 5 and the endless printing band 7 is sufficient to ensure idle rotation of the selector wheel S.

The selector wheel 5 can therefore rotate idly when an excessive external force acts thereon. Moreover, while the selector wheel 5 rotation itself acts more on the regulating boss portions 14A of the movable stopper member 14 than on the endless printing band 7, no hindrance to print character selection arises owing to wear of the movable stopper member 14 since it is harder than the endless printing band 7.

If the selector wheel 5 is rotated in the opposite (counterclockwise) direction, the engagement between the peripheral engagement notches 5B and the low drive projections 7D is reestablished and the elasticity of the movable stopper member 14 restores it to its original position shown in the top printer section 1A of FIG. 2.

The device for selecting print characters of endless printing bands in a printer 2 of the present invention can be used even when fitted with an endless printing band that uses drive projections different from those of the endless printing band 7 (FIG. 4). In the explanation that follows like portions to those in FIGS. 1 to 4 are assigned like reference symbols and a detailed description thereof will be omitted.

FIG. 5 is a side view of an example of another endless printing band 20. The endless printing band 20 is for full-periphery printing. It is provided on its outer peripheral side with the print characters 7A (28 in total) and the pair of symmetrically opposed blank sections 7C of the endless printing band 7 and is formed on its inner peripheral side with low drive projections 7D, but is not formed with display characters 7B, high drive projections 7E or flat portions 7F.

When print characters 7A are present over the entire periphery as here and a prescribed print character 7A is at the ink roller access opening 9, since no display characters 7B are formed, no display character 7B is present in the display window 8 to indicate this print character 7A. By compiling a character table showing the correspondence between the print characters 7A beforehand, however, it is possible when a certain print character 7A is located in the display window 8 to ascertain that a prescribed print character 7A is located at the ink roller access opening 9. Print selection using such a character table is possible in an actual printing operation.

FIG. 6 is a sectional view showing an example (printer 21) in which the endless printing band 20 is installed on one printer section (top printer section 1A) side. The top printer section 1A has full-periphery printing capability and the bottom printer section 1B side, as in FIG. 2, has half-periphery printing capability and display character 7B fouling prevention capability.

Compared with a completely half-periphery printing configuration, therefore, the number of printable characters can be increased to enable printing of a desired number of types of information, while fouling of the display characters 7B can be reliably prevented in half-periphery printing.

In the present invention, simple modification to the printer 22 shown in FIGS. 7 and 8 is also possible.

FIG. 7 is a sectional view of the printer 22 and a device for selecting print characters of endless printing bands 23 thereof. FIG. 8 is a sectional view taken along line VIII—VIII in FIG. 7. The printer 22 can use another endless printing band 24 whose drive projections have still another configuration.

FIG. 9 is a side view of the endless printing band 24. The endless printing band 24 is for half-periphery printing. It is provided on its outer peripheral side with the print characters 7A and display character 7B of the endless printing band 7 shown in FIG. 4, is formed at portions of the inner peripheral side opposite the display characters 7B with low drive projections 7D, is not formed with any low drive projections 7D but left as a flat portion 7F on the inner peripheral side of the print characters 7A, and, like the endless printing band 7, is formed with a pair of high drive projections 7E midway (at the middle) of the low drive projections 7D.

As shown particularly in FIG. 7, in the printer 22, instead of regulating blocks 6 in FIG. 6 the print character bearing bases 25 are detachably provided in the same locations to serve as print pressure bearing members.

Specifically, each print character bearing base 25 has an enlarged fastening portion 25A inserted into a sectionally circular engagement hole 15B in a stopper bearing member 15 and a fixing shaft 25B thereof is engaged with shaft supporting holes 3E of the printer frame 3 (FIG. 8), similarly to the block shafts 6B of the regulating blocks 6 (FIG. 3).

Of particular note is that since reinforced plastic of superior wear resistance and/or impact resistance can be used as the material of the print character bearing bases 25 that receive the print pressure, it is possible, by using a material different from that of the printer frame 3, to replace these as desired at desired timing and further to reduce overall cost.

In the two-stage printer 22 having the top printer section 1A and the bottom printer section 1B, moreover, common or shared use of components, including not only the movable stopper members 14 and the selector wheels 5 but also the print character bearing bases 25, is possible by flipping them over.

The so-configured printer 22, like the printer 1 of FIG. 2, also manifests both half-periphery printing capability and display character 7B fouling prevention capability.

In addition, the durability of print character bearing bases 25 as print pressure bearing members can be increased by forming them of a high-strength material different from that of the printer frame 3.

Since the print character bearing bases 25 are replaceable, moreover, components can be replaced as necessary, and, by replacing them with regulating blocks 6, the printer 22 can be converted into one like the printer 1 (FIG. 2) fitted with the endless printing band 7 of FIG. 4 or like the printer 21 (FIG. 6) fitted with endless printing band 20 of FIG. 6 in combination with the endless printing band 7.

It can therefore be used as a printer fitted as required with endless printing band(s) 7, 20, 24 or the like.

As explained in the foregoing, the print character selecting device 2 (FIG. 2) for the endless printing band 7, the endless printing band 20 (FIG. 5), or the printer 21 (FIG. 6), the printer 22 (FIG. 6) and other configurations according to the invention can be appropriately selected and combined as desired to configure a printer having fill-periphery printing capability and half-periphery printing capability.

FIG. 10 is a plan view of the display window 8 of a single-stage printer. As indicated at the display window 8 (and thus the ink roller access opening 9) portion, a first print region 26 from the first row to the fourth row adopts the configuration of the endless printing band 20 of FIG. 5 and the print character selecting device 2 shown in the top printer section 1A of FIG. 6 to achieve full-periphery printing.

Further, a second print region 27 from the fifth row to the tenth row adopts the configuration of the endless printing band 7 of FIG. 2 and the print character selecting device 2 of FIG. 2 or the configuration of the endless printing band 24 of FIG. 9 and the device for selecting print characters of endless printing bands 23 shown in FIG. 7 to achieve half-periphery printing and further to impart display character 7B fouling prevention capability.

FIG. 11 is a plan view of the display windows 8 of a two-stage printer. By similar means to that in the case of FIG. 10, all rows of the top printer section 1A shown above in the drawing can be adapted for full-periphery printing, a first print region 26 from the first row to the fourth row of the bottom printer section 11B shown below be adapted for full-periphery printing, and a second print region 27 from the fifth row to the tenth row thereof be adapted for half-periphery printing.

Since full-periphery printing using the endless printing band 20 (FIG. 5) in this manner enables disposal of more print characters 7A, alphabet and other desired symbols, for example, can be printed to represent various types of information.

On the other hand, half-periphery printing using the endless printing band 7 (FIG. 4) or the endless printing band 24 (FIG. 9) is tied in with display character 7B fouling prevention capability and, further, permits provision of, for example, numerals and the like.

Printing using the printer can therefore be imparted with diversity of kind and quantity to achieve the required printing capability.

Since, as set out in the foregoing, the present invention disposes endless printing bands between selector wheels and regulating blocks to achieve fouling prevention capability by idle rotating operation of the selector wheels, a printer and a print character selection device thereof can be realized that, by freely combining endless printing bands and the like, can have full-periphery printing and/or half-periphery printing capability, that are compatible with diverse specifications, and that are improved in reliability.

Further, since the present invention enables replacement of print character bearing bases as separate bodies from the printer frame, they can be made of a material such as reinforced plastic that has superior wear resistance and/or impact resistance, thereby contributing to improvement of reliability and component replacement workability.

Moreover, in accordance with the present invention, since the movable stopper members that produce the fouling prevention capability by idle rotating operation of the selector wheels are formed with stopper member side misassembly preventing slanted surfaces, workability at the time of assembly is improved and a contribution can be made to cost reduction.

In addition, the present invention enables desired combination of multiple rows of endless printing bands to realize full-periphery printing capability and half-periphery printing capability, permits design of the type and number of print characters in line with the type and amount of information to be printed, and makes possible a printer compatible with diverse printing specifications.

What is claimed is:

1. A device for selecting print characters in a printer stage section of a printer, wherein the printer includes at least one printer stage section and a printer frame, the printer stage section including a selector wheel rotatably mounted to the printer frame, a print pressure bearing member attached to the printer frame, and at least one endless printing band having an inner peripheral surface and a plurality of spaced print characters, the endless printing band contacting the selector wheel and cooperating with the selector wheel for selecting one of the print characters of the printing band upon rotation of the selector wheel, the device comprising:

a stopper guide coupled to the frame, the stopper guide being provided with at least one slanted surface;

a movable stopper member including an elongate guide window for engaging with the guide member, an elastic section and regulating boss portions, the movable stopper member being movable into an engaged position at which the regulating boss portions engage the selector wheel of the printer stage section such that the selector wheel is rotatable into discrete rotational positions for selecting the print characters of the printing band and a disengaged position at which the regulating boss portions are spaced away from the selector wheel, the movable stopper member being provided with at least one slanted surface configured to align with the slanted surface of the stopper guide when the movable stopper member is properly oriented to permit the elongate window of the movable stopper member to engage with the stopper guide, the slanted surfaces of the stopper guide and the movable stopper member not aligning with one another when the movable stopper member is improperly oriented to prevent the elongate window of the movable stopper member from engaging with the stopper guide, thereby preventing misassembly;

a stopper bearing member coupled to the frame and contacting the elastic section of the movable stopper member for regulating movement of the movable stopper member between the engaged and disengaged positions, the stopper bearing member biasing the movable stopper member into the engaged position;

drive projections coupled to the inner peripheral surface of the printing band for engaging the selector wheel, the drive projections being positioned to permit the selector wheel to select one of the print characters on the printing band when the selector wheel is rotated; and a regulating block rotatably mounted to the frame and configured to engage the drive projections so that the regulating block can rotate clockwise and counterclockwise in accordance with movement of the printing band to position the print characters of the printing band, the regulating block being biased by the print pressure bearing member for providing the selected print characters of the printing band with a print pressure;

wherein the elastic section of the movable stopper member prevents movement of the printing band when at least one of the drive projections contacts the elastic section of the movable stopper member, the drive projection causing the movable stopper to move into the disengaged position when contacting the elastic section of the movable stopper.

2. The device of claim 1, wherein the drive projection contact of the drive projection produces slack in the printing band when contacting the elastic section of the movable stopper member so that the drive projections disengage the selector wheel, thereby permitting the selector wheel to freely rotate.

3. The device of claim 1, wherein the endless printing band has an outer peripheral side, outer peripheral flat portions formed on the outer peripheral side, and inner peripheral flat portions formed on the inner peripheral side of the printing band, the inner peripheral portions facing the regulating block and being located opposite to the outer peripheral flat portions, the print characters not being positioned at the outer peripheral flat portions of the printing band.

4. The device of claim 1, wherein the printer includes two printer stage sections.

5. The device of claim 1, wherein the regulating block is interchangeable with a print character bearing base fixedly mountable on the printer frame.

6. The device of claim 5, wherein the print character bearing base is constituted of a harder material than the printer frame.

7. The device of claim 5, wherein the endless printing band has an outer peripheral side, outer peripheral flat portions formed on the outer peripheral side, and inner peripheral flat portions formed on the inner peripheral side and arranged opposite to the print characters, the inner peripheral flat portions engaging with the bearing base, the print characters not being positioned on the flat portions.

8. The device of claim 1, wherein the endless printing band is interchangeable with another endless printing band having differently configured drive projections.

9. The device of claim 1, wherein the drive projections include high drive projections for engaging with the movable stopper member and low drive projections that do not engage with the movable stopper member.

10. The device of claim 1, wherein the endless printing band has only low drive projections that do not engage with the movable stopper member.

11. A printer, comprising:

a plurality of rows of endless printing bands, some of the rows of printing bands being formed with print characters over about their entire peripheries, some of the rows of printing bands being formed with print characters over about half their peripheries and display characters over at least a portion of the remainder of their peripheries; and an arrangement for selecting a printing band in a desired row and for selecting a print character of the selected printing band.

12. The printer of claim 11, wherein each of the rows of printing bands formed with print characters over about their entire peripheries includes more print characters than each of the rows of printing bands formed with print characters over about half their peripheries.

13. The printer of claim 11, wherein the rows of the printing bands formed over about half their peripheries with the print characters have display characters corresponding to the print characters.

14. A printer, comprising:

a plurality of rows of endless printing bands, rows of the printing bands in a first printing region being formed with print characters over about their entire peripheries, rows of the printing bands in a second printing region being formed with print characters over about half their peripheries and display characters over at least a portion of the remainder of their peripheries; and an arrangement for selecting a printing band in a desired row and for selecting a print character of the selected printing band.

15. A device for selecting print characters in a printer stage section of a printer, wherein the printer includes at least one printer stage section and a printer frame, the printer stage section including a selector wheel rotatably mounted to the printer frame and at least one endless printing band having an inner peripheral surface and a plurality of spaced print characters, the endless printing band contacting the selector wheel and cooperating with the selector wheel for selecting one of the print characters of the printing band upon rotation of the selector wheel, the device comprising:

a stopper guide coupled to the frame, the stopper guide being provided with at least one slanted surface;

a movable stopper member including an elongate guide window for engaging with the guide member, an elastic section and regulating boss portions, the movable stopper member being movable into an engaged position at which the regulating boss portions engage the selector wheel of the printer stage section such that the selector wheel is rotatable into discrete rotational positions for selecting the print characters of the printing band and a disengaged position at which the regulating boss portions are spaced away from the selector wheel, the movable stopper member being provided with at least one slanted surface configured to align with the slanted surface of the stopper guide when the movable stopper member is properly oriented to permit the elongate window of the movable stopper member to engage with the stopper guide, the slanted surfaces of the stopper guide and the movable stopper member not aligning with one another when the movable stopper member is improperly oriented to prevent the elongate window of the movable stopper member from engaging with the stopper guide, thereby preventing misassembly;

a stopper bearing member coupled to the frame and contacting the elastic section of the movable stopper member for regulating movement of the movable stopper member between the engaged and disengaged positions, the stopper bearing member biasing the movable stopper member into the engaged position;

drive projections coupled to the inner peripheral surface of the printing band for engaging the selector wheel, the drive projections being positioned to permit the selector wheel to select one of the print characters on the printing band when the selector wheel is rotated; and a regulating block rotatably mounted to the frame and configured to engage the drive projections so that the regulating block can rotate clockwise and counterclockwise in accordance with movement of the printing band to position the print characters of the printing band.

* * * * *